US006029546A

United States Patent [19]

Gibson et al.

[11] Patent Number: 6,029,546

[45] Date of Patent: Feb. 29, 2000

[54] REACTION MEMBER SYSTEM FOR ROTARY FLUID-OPERATED WRENCHES

[75] Inventors: James D. Gibson; Richard J. Joye, both of Huntsville, Ala.

[73] Assignee: Parker-Hannifin Corporation, Cleveland, Ohio

[21] Appl. No.: 09/009,041

[22] Filed: Jan. 20, 1998

Related U.S. Application Data

[60] Provisional application No. 60/049,513, Jun. 13, 1997.

[51] Int. Cl.[7] ..... B25B 21/00

[52] U.S. Cl. ..... 81/57.44; 81/57.39; 81/55

[58] Field of Search ..... 81/57.44, 57.24, 81/57.39, 180.1, 55

[56] References Cited

U.S. PATENT DOCUMENTS

| | | | |
|---|---|---|---|
| Re. 33,951 | 6/1992 | Junkers . | |
| 3,198,040 | 8/1965 | Franck | 81/55 |
| 3,706,244 | 12/1972 | Wilmeth . | |
| 4,086,830 | 5/1978 | Latham . | |
| 4,106,371 | 8/1978 | Akiyoshi et al. . | |
| 4,200,011 | 4/1980 | Wilmeth . | |
| 4,309,923 | 1/1982 | Wilmeth . | |
| 4,385,533 | 5/1983 | Collins . | |
| 4,406,185 | 9/1983 | Junkers | 81/57.39 |
| 4,406,187 | 9/1983 | Osborne, Jr. . | |
| 4,409,865 | 10/1983 | Krautter et al. . | |
| 4,429,597 | 2/1984 | Grabovac et al. . | |
| 4,432,256 | 2/1984 | Aparicio, Jr. et al. . | |
| 4,480,510 | 11/1984 | Aparicio, Jr. et al. . | |
| 4,706,526 | 11/1987 | Junkers . | |
| 4,706,527 | 11/1987 | Junkers . | |
| 4,748,873 | 6/1988 | Snyder . | |
| 4,794,825 | 1/1989 | Schmoyer . | |
| 4,825,730 | 5/1989 | Junkers . | |
| 4,916,986 | 4/1990 | Junkers . | |
| 5,140,874 | 8/1992 | Junkers . | |
| 5,142,951 | 9/1992 | Walton . | |
| 5,203,238 | 4/1993 | Ferguson . | |
| 5,301,574 | 4/1994 | Knopp et al. . | |
| 5,357,828 | 10/1994 | Spirer . | |
| 5,369,867 | 12/1994 | Koppenhoefer et al. . | |
| 5,398,574 | 3/1995 | Spirer . | |

OTHER PUBLICATIONS

Pamphlet of Hytorc, Division of Unex Corporation entitled "Shop Talk".

Brochure of Hytorc entitled "Bolting Tool Innovations!".

Catalog of Hytorc dated 1991.

Literature of Sweeney, a Dover Diversified Company, for RSL Hydraulic Wrenches.

*Primary Examiner*—D. S. Meislin

*Attorney, Agent, or Firm*—John A. Molnar, Jr.

[57] ABSTRACT

A reaction system for use in combination with a fluid-powered wrench tool in assembling or disassembling large size tube fittings of a variety including a fastener or nut which is threadably engagable with a port end of the fitting body. The system includes a reaction member attachable to the tool as extending along a central longitudinal axis disposed general parallel to the line of action of the cylinder assembly of the tool from a forward end face positionable in confrontation with the fastener to an opposite rearward end face. The system also includes an associated wrench member which is provided as having a rearward shank end mountable to the reaction member and a forward jaw end configured to receive the external surface of the fitting body in an engagement which delimits the rotation of the fitting body in a first direction about the axis of rotation of the fitting fastener.

24 Claims, 11 Drawing Sheets

REACTION MEMBER SYSTEM FOR ROTARY FLUID-OPERATED WRENCHES

RELATED CASES

The present application claims priority to U.S. Provisional Application Ser. No. 60/049,513 filed Jun. 13, 1997.

BACKGROUND OF THE INVENTION

The present invention relates generally to a reaction member attachment system for use with a hydraulic, pneumatic, or other rotary fluid-operated wrench, and more particularly to such a system which is adapted for the assembly of large size tube fittings.

The petrochemical and other industrial process industries historically have relied upon threaded pipe and welded connections in the construction of fluid piping systems. More recently, however, large diameter tubing, i.e., 1¼–2 inch O.D., and associated tube fittings therefor in inch sizes 20, 24, and 32, and metric sizes 28 mm, 32 mm, and 38 mm, for example, have been suggested as a substitute in affording both faster and more reliable make-up without the need for welds and X-ray inspection, and in affording easier disassembly for line inspection, maintenance, and cleaning.

Other than being of a relative large size, the tube fittings of the type herein involved are well known as employed in a variety of installations to connect two or more runs of tubing, pipes, lines, or other conduits in fluid communication at a central junction. In basic construction, such fittings typically are formed from a metal such as copper, brass, steel, or stainless steel as a pressure vessel body having two or more branches or bosses for mechanical coupling to the ends of the tubes to be joined. Depending upon the number and relative orientations of the branches of the fitting, two port elbows and straights, and other configurations such as multi-port tees or crosses having three or more ports may be provided. The external surface of the body typically is configured as having hexagonal or other flats portions for engagement with a wrench or other tool during make-up or disassembly. Tube fittings of this type, which may be of a "flareless," ferruled variety, are manufactured by the Instrumentation Connectors Division of Parker-Hannifin Corp., Huntsville, Ala., under the tradenames A-Lok® and CPI™ Instrumentation Tube Fittings, and by the Crawford Fitting Co., Solon, Ohio, under the tradename "Swagelok™."

A representative tube fitting of the above-described ferruled variety is described in commonly-assigned U.S. Pat. No. 3,499,671. As may be seen for the straight embodiment shown generally at 10 in FIG. 1, such fitting includes a body member, 12, having an internal central bore, 14, and an external surface, 16. Surface 16 is configured as having hexagonal flats for engagement with a wrench or other assembly tool. Bore 14, in turn, is configured to receive a distal end, 18, of a length of tubing, 20, at least partially therethrough as extending within body member 12 between a rearward port end, 22, and a forward internal shoulder, 24, thereof. Port end 22, which is externally-threaded, opens to receive the tubing distal end, and defines at that opening an internal circumferential sealing surface, 26, of a generally frustoconical or flared geometry. Shoulder 24, in turn, extends radially inwardly to provide a positive stop for the internal positioning of the tubing distal end within bore 14. In the representative configuration shown in the figure, fitting 10 has a forward port end, 27, which is tapered for a threaded pipe connection, but which alternatively may be configured for a second tubing connection.

For effecting a fluid-tight connection between the fitting body and the tubing, the tubing distal end 18 is received through a generally annular ferrule, 28, which is interposable coaxially between the fitting sealing surface 26 and the outer surface, 30, of the tubing distal end. In this regard, ferrule 28 includes a forward end, 30, and a rearward end, 32. The forward end 30 of ferrule 28 is configured as having a tapered outer surface for effecting a compressive, fluid-tight engagement with surface 26 of body member 12. In turn, the rearward end 32 of ferrule 28 is configured for an abutting engagement with radially-inward extending internal shoulder, 34, of an associated nut or other fastening member, 36, which likewise is received coaxially over the tubing distal end 22. As is shown, with ferrule 28 axially positioned between nut 36 and body member port end 22, and with tubing distal end 18 bottomed out on shoulder 34, nut 36 may be threadably rotatably engaged with the port end 22 of the body member urging the forward end 30 of the ferrule into an abutting, fluid-tight engagement with the sealing surface 26 of the body member. Moreover, as nut 36 is tightened onto port end 22, the forward end 30 of the ferrule is compressed radially inwardly to grippably retain the tubing distal end 18 and develops an additional sealing surface being developed therebetween.

Generally with respect to such tube fittings, sufficient torque must be applied to the nut to effect the compression of the ferrule necessary to develop a fluid-tight seal. Particularly with respect to large size fittings, this torque may be appreciable and difficult to develop by conventional methods. Heretofore, the state of the art in large size fitting assembly has involved the use of a pair of hand-operated wrenches of correspondingly large proportions. That is, in order to provide a lever arm capable of developing the necessary torque, the wrenches were extremely long and, necessarily, very heavy. Indeed, "cheater" bars often are used to extend the leverage of the wrenches. With one of these wrenches positioned and held manually by a technician on the body of the fitting to counteract the applied torque, another technician then had to position the other wrench on the nut for clockwise or counterclockwise rotation to effect its tightening or loosening. While the nut was being tightened, the rotations thereof typically were counted to assure that a proper connection was established.

It will be appreciated, however, that in the field, conditions may arise which limit access to the fitting. For example, adjacent runs of tubing may interfere with the positioning or rotation of the wrenches. With respect to tees and crosses, the access to the nut and fitting body is especially limited. Moreover, the technicians may be called on to operate the wrenches high above the ground or in other dangerous environments. Obviously, there is the constant potential for bodily injury should one of the wrenches slip. Given all these conditions, it sometimes occurs that the specified number of nut rotations could not be safely achieved. In such situations, the only recourse had been to operate the system at less than its specified fluid pressure and/or to endure some amount of leakage from the improperly made-up fitting.

With respect to bolt assembly application, such as in the tightening of pipe flange bolts, hydraulic and other fluid operated wrenches have been employed to alleviate the above-mentioned problems associated with hand wrenches. One such fluid wrench for turning threaded connectors is described in U.S. Pat. No. 4,825,730, reissued as Re. 33,951, as including a housing which accommodates a double-acting drive cylinder having an internal piston reciprocatingly movable therein under the action of a hydraulic or pneumatic fluid medium supplied by a separate pump for alternately extending and retracting an associated ram. The wrench further includes an engaging unit which is operably coupled with the ram and is powered under the control thereof for turning the threaded connector. The engaging unit includes a link having a central opening, and a toothed ratchet wheel which is rotatably received within the opening as configured to engage, for example, the hexagonal head of a bolt or nut. The link has an upper end which is pivotally connected with a free end of the ram by a connecting means such as a pin. A cooperating pawl is pivotally connected to the link such that when the link is rotated in a working direction by a power stroke of the ram, the pawl enmeshes with grooves of the teeth of the ratchet wheel to incrementally rotate the wheel with the link. However, when the link is rotated in an opposite direction by the return stroke of the ram, the pawl is configured to traverse over the ratchet wheel in a lost motion arrangement permitting the link to be repositioned for continued application of torque on the next power stroke of the ram.

The wrench also includes a reaction member which is attachable to the link via one or more pins. During the power stroke of the ram effecting the rotation of the link and ratchet in a first direction about an axis of rotation, a reaction force or moment is developed which tends to rotate the cylinder and housing in the opposite direction about the axis. The reaction member restrains the end of the cylinder opposite the ram in providing a reaction surface for bearing contact with a fixed object adjacent the bolt to be tightened or loosened. Depending upon the geometry of and available clearance in the bolt tightening application for which the wrench is intended, the reaction member may be configured as a pad or as an elongate lever for contact with the adjacent object.

For example, U.S. Pat. No. 4,706,527 discloses a reaction member which comprises a splined annular portion which is configured to adjustably engage the splines of a reaction support portion of a housing. A second portion of the reaction member is integrally formed with the first portion as extending laterally therefrom in the direction of the axis of the ratchet to abut, for example, the outer surface of a flange in which a threaded connector is provided. The reaction member thus is adjustable to any desired position depending up the direction of the reaction force.

U.S. Pat. No. 4,794,825 similarly discloses a reaction arm member which is removably connectable to the wrench housing in a multiplicity of rotational orientations relative thereto. The reaction arm member comprises an internally-splined, annular body portion and an integral L-shaped reaction arm which projects transversely from the body portion. For the adjustable, coaxial mounting of the reaction arm member thereto, the wrench housing includes a cylindrical rear portion which is formed as having a plurality of circumferential, axially extending grooves. Each of these grooves is configured to received a corresponding spline of the reaction arm member providing an interlocking engagement between the reaction arm member and the housing.

U.S. Pat. No. 5,142,951 discloses a reaction member which is rotatably positionable about an axis which extends parallel to the drive axis of the wrench. The member includes a pair of elongate support arms which extend from a cylindrical socket portion. The support arms are pivotally attached to a body portion of the wrench such that the socket portion is rotatably positionable for engagement with a bolt or other fixed adjacent to the bolt be tightened or loosened.

U.S. Pat. No. 4,385,533 discloses a reaction plate assembly for use in a hydraulic torque wrench. The assembly includes a generally flat, triangular plate which is attached to one end of the drive cylinder opposite the wrench socket. The plate is provided as having a perimeter section which is formed with a series of spaced-apart clevis bolt opening, and as having a perpendicular section which is formed with at least one ring bolt opening. The clevis section is positionably attachable to the cylinder end, with the nut ring of the other section being receivable over a nut located adjacent to the nut that is to be tightened or loosened.

U.S. Pat. No. 4,406,187 discloses an anchoring mechanism for preventing the counter-rotation of a motor driven wrench in reaction to the torque produced by the turning of a tool member. The anchoring mechanism has a plurality of tandemly-hinged members. One end of the members is attachable to the wrench, with the other end of the member being securable to a fixed reference base.

U.S. Pat. No. 4,106,371 discloses a power wrench tool for tightening a bolt, nut, or the like having an anti-reaction member for preventing the rotation of the tool due to reaction force. The anti-reaction member is configured to engage an adjacent nut.

In the operation of the representative fluid wrench described in U.S. Pat. Nos. 4,825,730 and Re. 33,951, the ratchet is engaged with the threaded connector to be turned, and the reaction member is abutted against an adjacent object. On the power stroke, working fluid pressure is admitted into one end of the cylinder via an associated supply line to displace the piston and thereby extend the ram. Responsive to the extension of the ram, the link is rotated a fixed angular displacement in a clockwise or counterclockwise direction, with the pawl and the ratchet enmeshed therewith being turned incrementally with the link. On the return stroke, fluid is admitted into the other end of the cylinder via a corresponding supply line to retract the ram and rotate the link in a reverse direction. The ratchet wheel, however, is made to remain stationary as the pawl is provided to slip over the teeth of the ratchet.

Other fluid operated wrenches which operate in a manner similar to that just described are shown in U.S. Pat. Nos. 5,398,574; 5,369,867; 5,357,828; 5,301,574; 5,203,238; 5,142,951; 5,140,874; 4,916,986; 4,794,825; 4,748,873; 4,706,526; 4,706,527; 4,480,510; 4,432,256; 4,429,597; 4,409,865; 4,309,923; 4,200,011; 4,086,830; and 3,706,244. Fluid operated wrenches are manufactured commercially by the Hytorc Division of Unex Corp., Mahwah, N.J., and by Sweeney Co., Englewood, Calif.

One such other wrench incorporates a hinged ratchet link assembly or head for greater accessibility to the workpiece. As is shown generally at 40 in the somewhat simplified, exploded view of FIG. 2, such head, which is marketed commercially by Hytorc under the name "Swing-Link™," includes a housing, 42, which accommodates a drive cylinder, 44, having an internal piston (not shown). As before, the piston is reciprocatingly movable within cylinder 44 under the action of a hydraulic or pneumatic fluid medium supplied via one or more hoses or other conduits, one of which is referenced at 46, by a separate pump (not shown) for alternately extending and retracting an associated ram which is hidden in the view shown. Wrench 40 further includes an link assembly, shown generally at 48, which is operably couplable with the ram and is powered under the control thereof for the application of torque to a threaded connector or other workpiece. As may be seen with additional reference to the cross-sectional view of FIG. 3, link assembly includes a body portion, 50, which may be of a parallel plate construction, and a swing arm portion, 54, which depends from the body portion. Body portion 50 includes an attachment end, which is shown at 56 to be configured for a pivotable connection with a corresponding mount portion of housing 42 as having an upper slot or rebate, 58, receivable on a transversely-disposed pin, 60, of the housing, and a lower aperture, 62, configured for a straddling pin-mount registration with a depending boss, 64, of the housing.

Swing arm 54 is hingably coupled via pin 68 to one end of body portion 50. A split inner carrier, 70, adapted to be rotatably received within swing arm 54, is similarly hinged via pin 72 to be openable for accessing the workpiece. When closed (FIG. 4), carrier 70 defines with body portion 50 a central opening, 74, of the link for rotatably supporting an annular ratchet wheel insert, 75*a–b*. As is shown, ratchet wheel 75 also may be of a split, two-piece construction, each piece having a toothed outer circumference, 76*a–b*, configured for engagement with a cooperating pawl assembly of the carrier, and an inner circumference, 78*a–b*, with defines with the other piece a hexagonal-shaped opening, 80, configured to receive a correspondingly-shaped connector or other workpiece in a torque transmitting engagement therewith.

Looking additionally to FIG. 4, as is shown in phantom at 70', carrier 70 is rotatable within opening 74 along a plurality of bearings, one of which is referenced at 90, which are received within an arc-shaped raceway, 92. Carrier 70 includes a connecting portion, 94, configured for an operable coupling with the with piston ram. In this regard, the carrier is actuable by a power and return stroke of the cylinder for a reciprocating rotation about a central axis of rotation, referenced at 95, which corresponds to the axis of rotation of the subject workpiece. One or more spring-loaded pawls, two of which are referenced at 96*a–b*, are associated with carrier 70 for rotation therewith as configured to drivably engage the toothed outer circumference 76 of ratchet wheel 75. On the power stroke of the cylinder, the pawls thereby urge ratchet wheel 75 to rotate about the axis 95 in the torque-developing direction shown at 97. Depending on the size of the fastener, torques of about 100–1200 ft-lb, or more, may be developed for application to the fastener. On the return stroke of the cylinder, which need develop a torque of only about 1–2 ft-lb to rotate the carrier, the pawls are biased to traverse over the ratchet wheel to allow the repositioning of the carrier for the application of torque on the next power stroke of the cylinder.

In use, with ratchet wheel 75 positioned to engage the connector, carrier 70 and then swing arm 54 each may be clamped and secured around the wheel and with one or more fastening members, such as the cap screws pictured at 98*a–b*. Thereupon, on the power stroke of the cylinder, the ratchet wheel is rotated by the carrier to apply the developed torque to the fastener. Responsive to the applied torque, the fastener turns with the wheel in a first direction about the axis of rotation. By reversing the clamping of the wrench around the wheel, the direction of the applied torque may be changed to effect the rotation of the fastener in an opposite second direction about the axis. In this way, the fastener may be either tightened or loosened. It will be appreciated that wrench 40 is particularly adapted for applications wherein the connector to be rotated cannot be accessed from a distal or free end of the connector.

Although fluid operated wrenches, such as the above-described "Swing-Link™" wrench, have represented an advancement in the assembly of threaded connectors such as flange bolts, these wrenches have yet to be accepted for large size tubing fitting assembly applications. In this regard, tube fittings present unique geometric constraints which heretofore have frustrated the use of these wrenches. For example, in the make-up of multiport fittings such as tees and crosses, minimal opportunities are presented for access to the body of the fitting. Of course, if the fitting body is not immobilize as the nut is rotated, the body itself will have a tendency to rotate in the direction of the applied torque. Even with respect to the make-up of straight tube fitting, such fittings have geometries which are not amenable to access with the reaction members heretofore known in the art.

As the use of large diameter tubing in chemical process and other fluid transfer applications continues to increase, it will be appreciated that improvements in the assembly of large size fittings therefor would be well-received by industry. Preferred improvements would speed and simplify assembly, while minimizing the potential for leaks and injury to personnel.

SUMMARY OF THE INVENTION

The present invention is directed to a reaction system for use in combination with a fluid-powered, rotary wrench tool in the assembling, i.e., make-up, or disassembling of large size tube fittings. In providing a reaction member which is removably attachable to the housing of the tool and which may interchangeably receive one or more wrench members for engagement with the body of the fitting, the system thereby adapts the tool for use in tube fitting applications. That is, the system engages the fitting to delimit the rotation thereof as the fitting fastener member is turned by the ratchet wheel of the wrench tool.

In one preferred embodiment, the reaction member includes transverse first and second bearing portions which each extend laterally from opposite sides of the member for abutting engagement with the tubing itself. For fitting shapes such a tees and crosses presenting limited or substantially no access to the fitting body, the bearing members are configured to engage, for example, a length of tubing received within an adjacent port of the fitting. By engaging the tubing within an adjacent port, the associated fastener of another port thereby may be turned with the tool without rotating the fitting body. Advantageously, if an adjacent length of tubing is unavailable, a separate reaction bar member may be ubstituted.

It therefore is a feature of a preferred embodiment of the present invention to provide a reaction system for use in combination with a fluid-powered wrench tool in assembling or disassembling large size tube fittings of a variety including a fastener or nut which is threadably engagable with a port end of the fitting body. The system includes a reaction member attachable to the tool as extending along a central longitudinal axis disposed general parallel to the line of action of the cylinder assembly of the tool from a forward end face positionable in confrontation with the fastener to an opposite rearward end face. The system also includes an associated wrench member which is provided as having a rearward shank end mountable to the reaction member and a forward jaw end configured to receive the external surface of the fitting body in an engagement which delimits the rotation of the fitting body in a first direction about the axis of rotation of the fitting fastener.

It is a further feature of a preferred embodiment of the present invention to provide a reaction system for use in combination with a fluid-powered wrench tool in assembling or disassembling large size tube fittings of a variety including a first port end disposed along a first fitting axis and configured to receive a distal end of a first length of tubing, at least a second port end disposed along a second fitting axis aligned generally perpendicular to the first fitting axis and configured to receive a distal end of a second length of tubing, and at least a first and a second fastener each journalable over an associated tubing distal end for threadably engaging the corresponding port end of the fitting along a central axis of rotation. The system includes a reaction member attachable to the tool as extending along a central longitudinal axis disposed general parallel to the line of action of the cylinder assembly of the tool from a forward end face positionable in confrontation with the fastener to an opposite rearward end face. The reaction member has at least a first bearing portion projecting outwardly therefrom along a second longitudinal axis disposed generally perpendicularly to the first longitudinal axis. With the distal ends of the first and second lengths of tubing being received within the corresponding port end of the fitting, and with the ratchet wheel of the link assembly being engaged with the second fastener as journaled over the distal end of the second length of tubing, the reaction member first bearing portion is abuttingly engagable with the first length of tubing to delimit the rotation of the fitting body in the first direction about the axis of rotation of the second fastener.

It is also a further of a preferred embodiment of the present invention to provide a reaction system for use in combination with a tool for applying torque to a first member which is rotatable about an axis of rotation relative to a second member couplable in a torque-transmitting arrangement therewith. The system includes a reaction body attachable to the tool as extending along a central longitudinal axis disposed general parallel to the line of action of the cylinder assembly of the tool from a forward end face positionable in confrontation with the first member to an opposite rearward end face. The system also includes an associated wrench which is provided as having a rearward shank end mountable to the reaction body and a forward jaw end configured to receive the second member in an engagement which delimits the rotation of the second member in a first direction about the axis of rotation of the first member when the first and second members are coupled in a torque-transmitting arrangement.

It is a still further feature of a preferred embodiment of the present invention to provide a reaction system for use in combination with a tool for applying torque to a first member which is rotatable about an axis of rotation relative to a second member couplable in a torque-transmitting arrangement therewith. The system includes a reaction body attachable to the tool as extending along a central longitudinal axis disposed general parallel to the line of action of the cylinder assembly of the tool from a forward end face positionable in confrontation with the first member to an opposite rearward end face. The reaction member has at least a first bearing portion projecting outwardly therefrom along a second longitudinal axis disposed generally perpendicularly to the first longitudinal axis. With the ratchet wheel of the link assembly being engaged with the first member, the reaction body first bearing portion is abuttingly engagable with the second member delimiting the rotation thereof in the first direction about the axis of rotation when the first and second members are coupled in a torque-transmitting arrangement.

The present invention, accordingly, comprises the system possessing the construction, combination of elements, and arrangement of parts and steps which are exemplified in the detailed disclosure to follow. Advantages of the present invention include a system for providing leak-tight connections in large size tube fittings with no presetting of the ferrule on the tubing. Additional advantages include a system for making, remaking, or disassembling connections in large size tube fittings which is easier, simpler, and safer than the methods heretofore known in the art, and which may be used by a single operator even in confined work spaces. Still further advantages include a system which includes a reaction member that is retrofittable on existing fluid-operated wrench designs, and which may be removably attached to the wrench housing using a single pin connection. The reaction member, moreover, may be configured to accommodate different fitting sizes and shapes including straights, elbows, tees, and crosses. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

Figure 1:
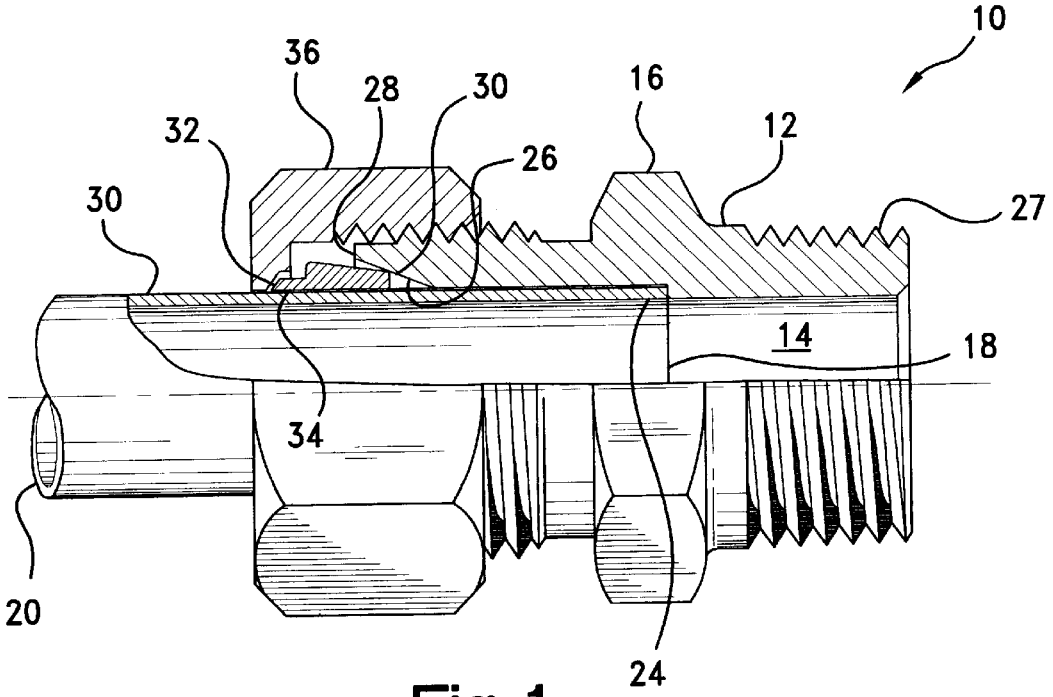
Fig. 1 (PRIOR ART)
FIG. 1 is a side elevational view, partially in longitudinal cross-section, of a representative large size tube fitting of the type herein involved.

The drawings will be described further in connection with the following Detailed Description of the Invention.

DETAILED DESCRIPTION OF THE INVENTION

Certain terminology may be employed in the description to follow for convenience rather than for any limiting purpose. For example, the terms "forward," "rearward," "right," "left," "upper," and "lower" designate directions in the drawings to which reference is made, with the terms "inward" and "outward" referring, respectively, to directions toward and away from the center of the referenced element, and the terms "radial" and "axial" referring, respectively, to directions perpendicular and parallel to the longitudinal central axis of the referenced element. Terminology of similar import other than the words specifically mentioned above likewise is to be considered as being used for purposes of convenience rather than in any limiting sense.

Figure 2:
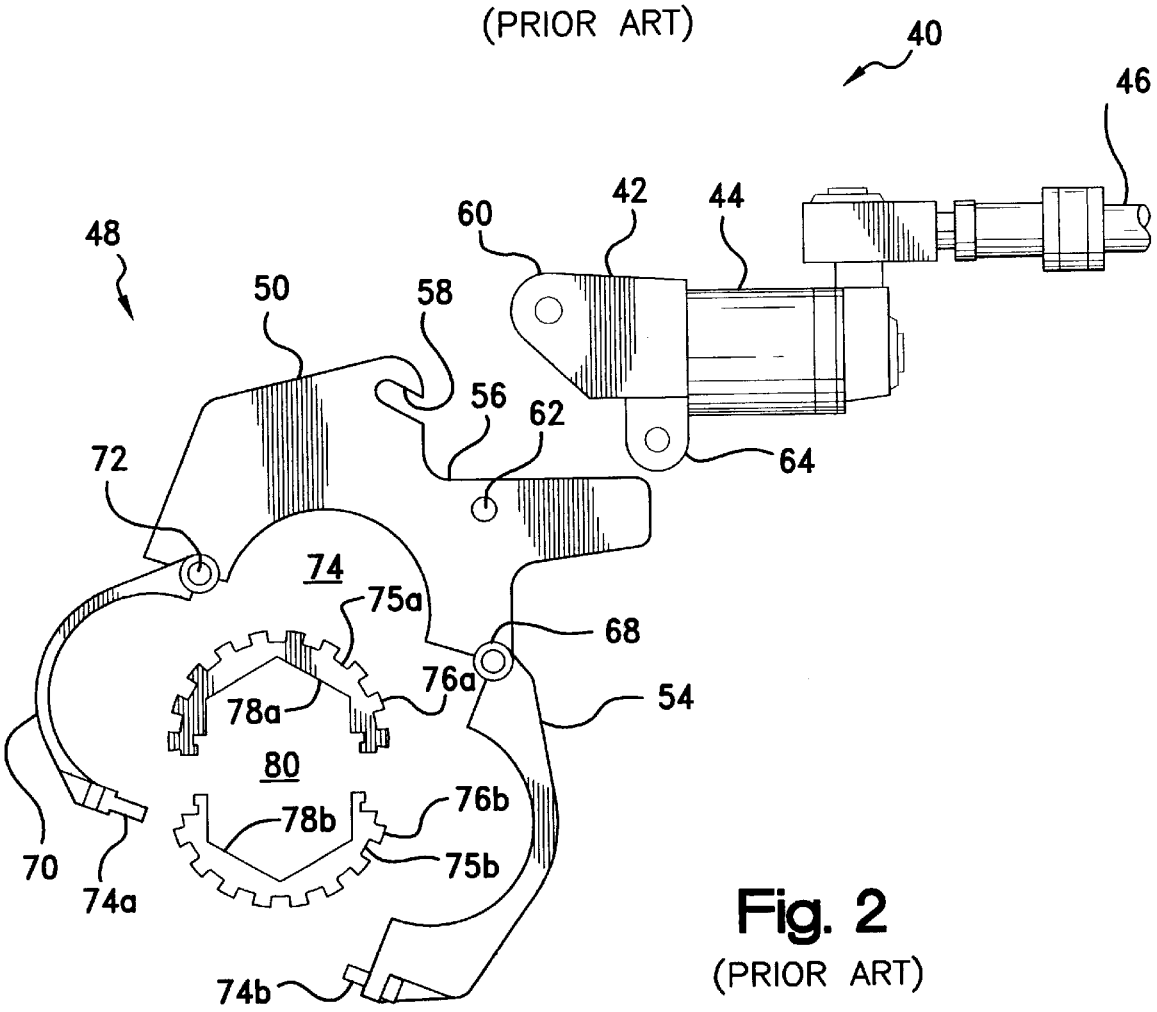
Fig. 2 (PRIOR ART)
FIG. 2 is an exploded side elevational view of a rotary powered head for a fluid operated wrench tool of the type herein involved for use in combination with the reaction member system of the present invention, the head including a hinged ratchet link assembly for operably coupling to an associated drive cylinder and support housing.
Figure 3:
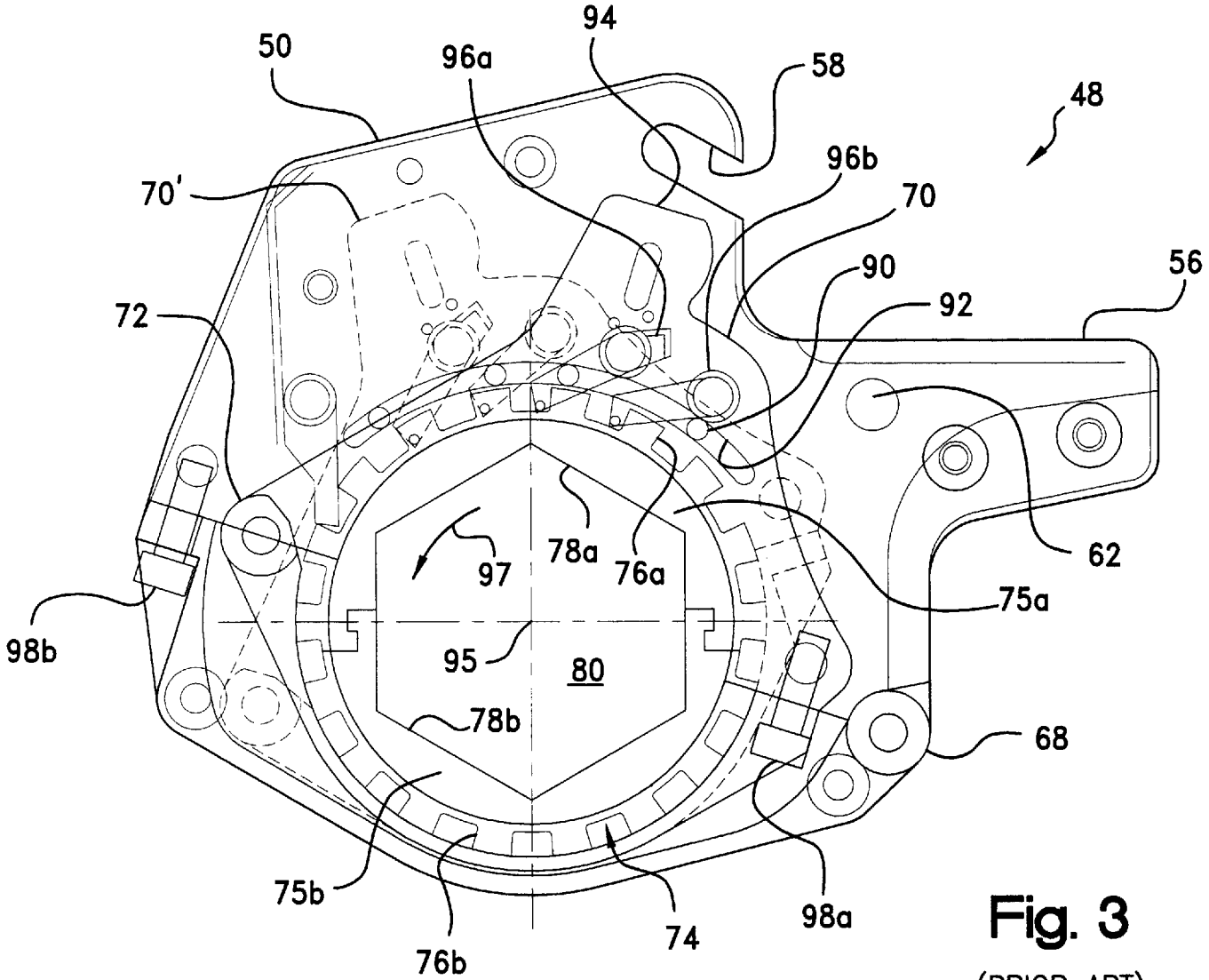
Fig. 3 (PRIOR ART)
FIG. 3 is an internal view of the link assembly of the fluid-operated wrench tool of FIG. 2.

For the purposes of the discourse to follow, the precepts of the invention herein involved are described in connection with its utilization in combination with the rotary hydraulic wrench shown in FIGS. 2 and 3 having a hinge ratchet link assembly for greater workpiece accessibility. It will be appreciated, however, that aspects of the present invention may find utility in other rotary fluid-operated wrenches. Use within those such other tools and methods therefore should be considered to be expressly within the scope of the present invention.

Figure 4:
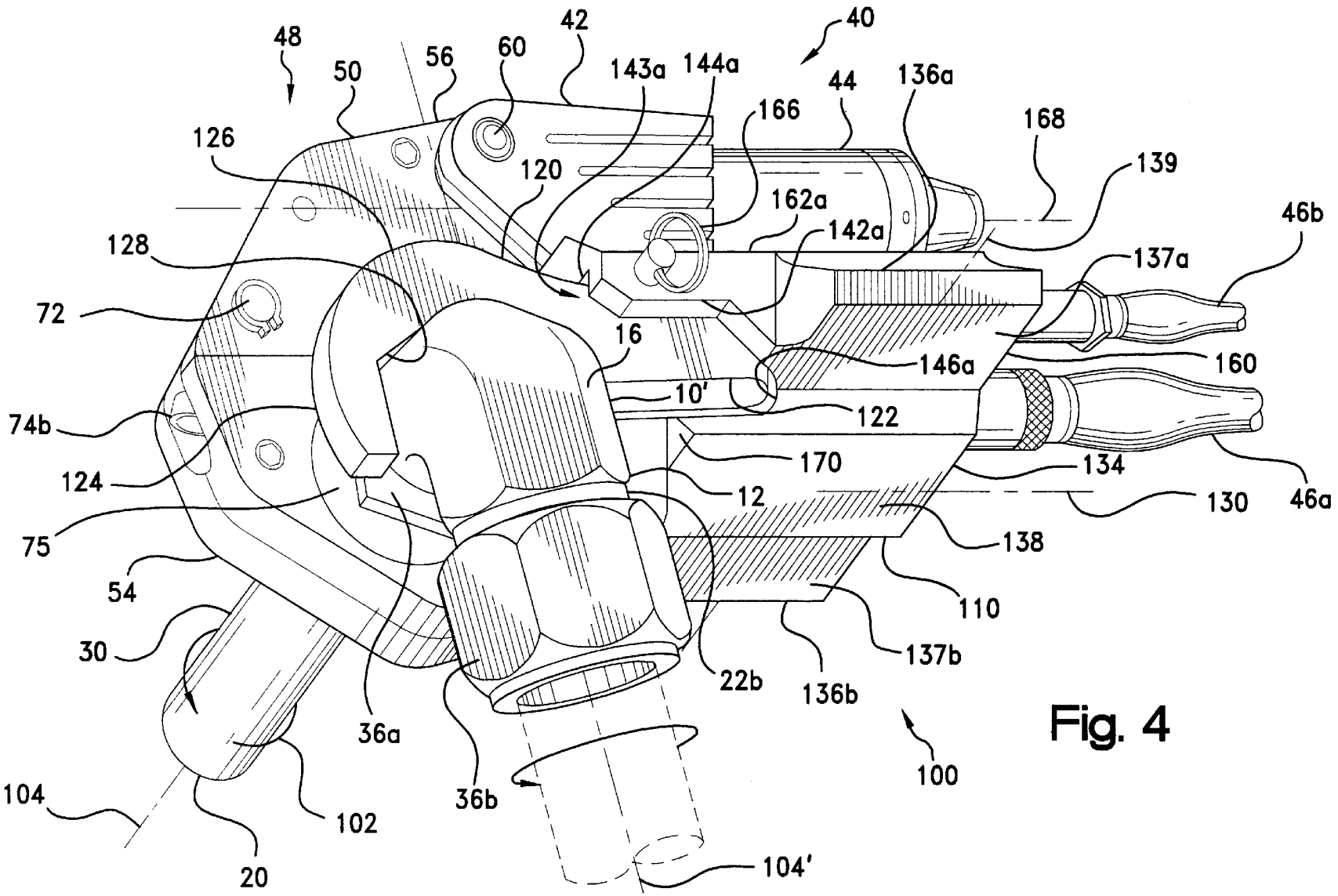
FIG. 4 is a perspective right side elevational view of one preferred embodiment of the reaction member system of the present invention including a reaction member which is attached to the housing of the tool of FIG. 2 and a wrench member mounted on the reaction member for engagement with an elbow-shaped tube fitting.
Figure 5:
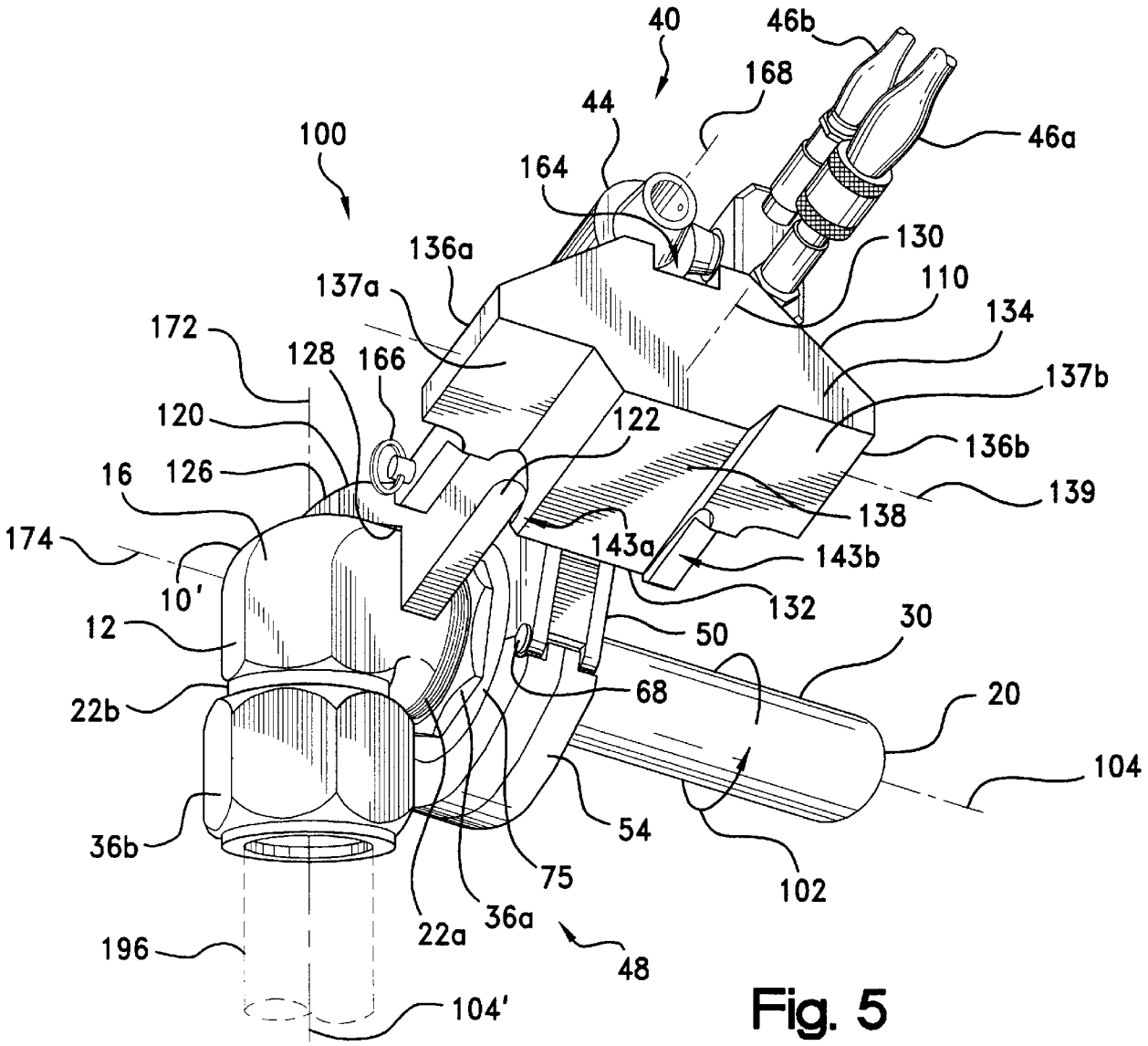
FIG. 5 is a perspective rear elevational view of the reaction member system of FIG. 4.
Figure 6:
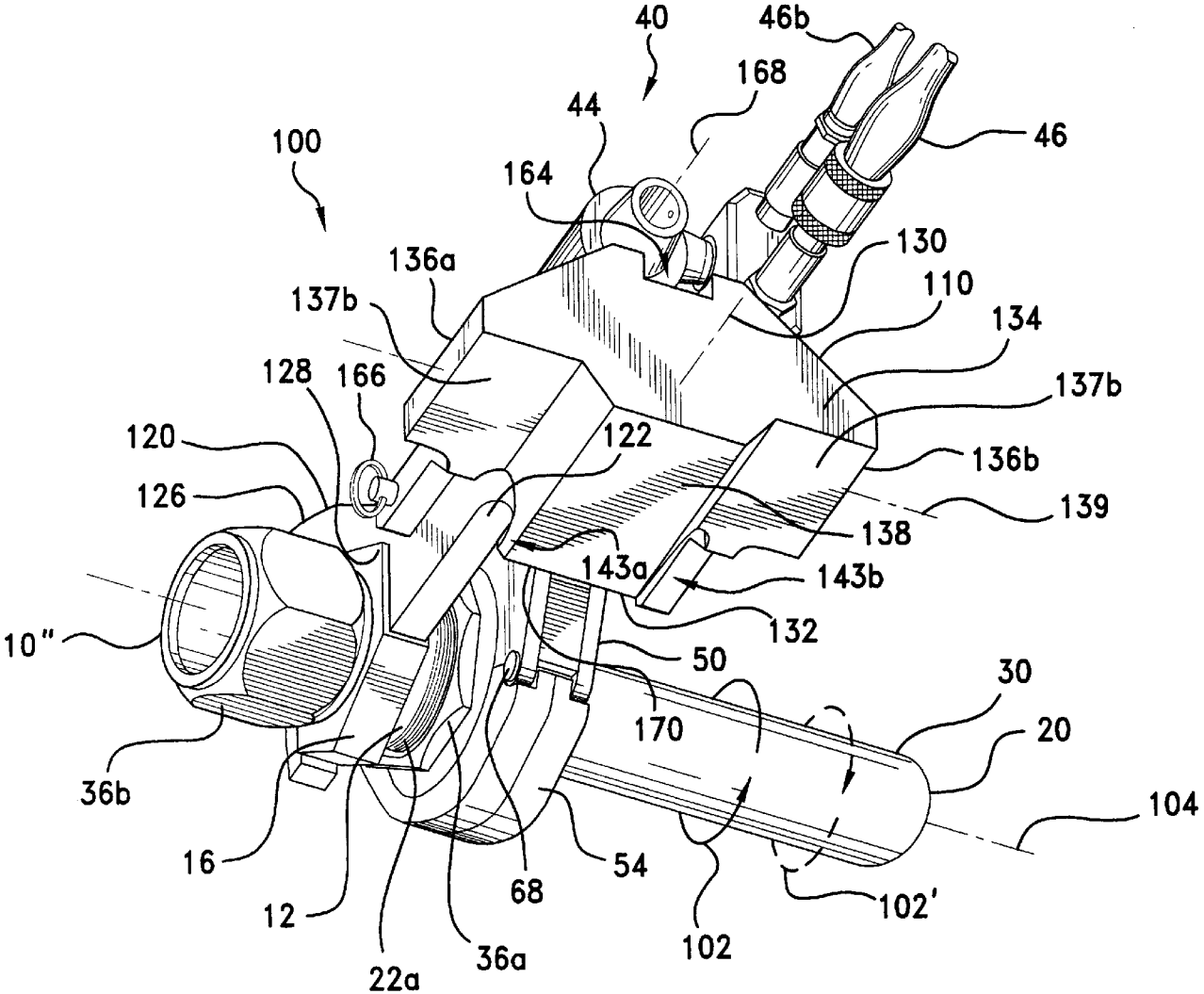
FIG. 6 is a perspective rear elevational view of the reaction member system of FIG. 4 as engaged with a straight tube fitting.

Referring then to the figures wherein corresponding reference characters are used to designate corresponding elements throughout the several views, with duplicate elements being designated in alphanumeric succession and with equivalent elements being referenced with prime designations, a reaction member system in accordance with the present invention is shown generally at 100 in the perspective views of FIGS. 4, 5, and 6. For illustrative purposes, system 100 of the invention is shown as being used in combination with the hinged link wrench tool 40 of FIGS. 2 and 3, for the make-up of an elbow shape tube fitting, 10' (FIGS. 4 and 5), and a straight fitting, 10" (FIG. 6). In this regard, link assembly 48 of tool 40 is shown in FIGS. 4 and 5 as operably engaged with fastener 36*a* of fitting 10', and in FIG. 6 as operable engaged with fastener 36*a* of fitting 10", for the application of torque to the fasteners effecting the rotation thereof in a first direction, referenced at 102, about a corresponding axis of rotation, referenced at 104.

System 100 includes a reaction member, 110, which is attachable to housing 42 of tool 40, and an associated, discrete wrench member, 120, for engaging a portion of the external surface 16 of fitting body 12 delimiting the rotation thereof in the first direction 102 as the fastener 36*a* is rotated in that direction about axis 104 by link assembly 48. In this regard, and as may be seen with momentary reference to FIG. 6, wrench member 120 has a rearward, generally elongate shank end, 122, which is mountable to the reaction member, and a forward jaw end, 124, which is configured to receive the external surface 16 of the fitting body 12 delimiting the rotation thereof. Preferably, the jaw end 124 of wrench member 120 is formed as having a closed upper portion, 126, and an open lower span, referenced at 128, which is receivable over the fitting external surface 16.

Figure 8B:
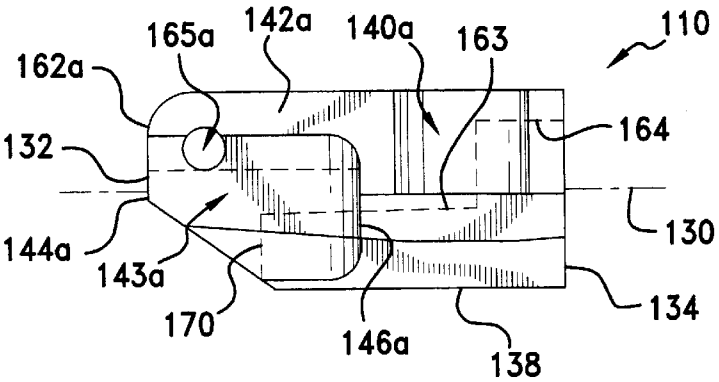
FIG. 8B is a right side view of the reaction member of FIG. 4.
Figure 8A:
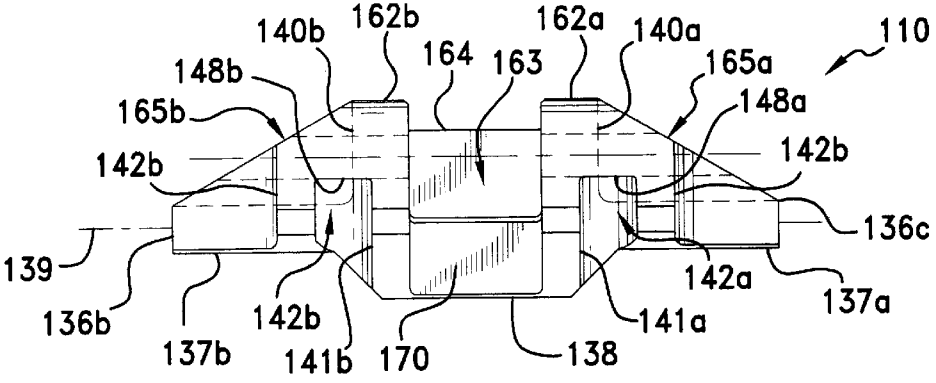
FIG. 8A is front view of the reaction member of FIG. 4.
Figure 8C:
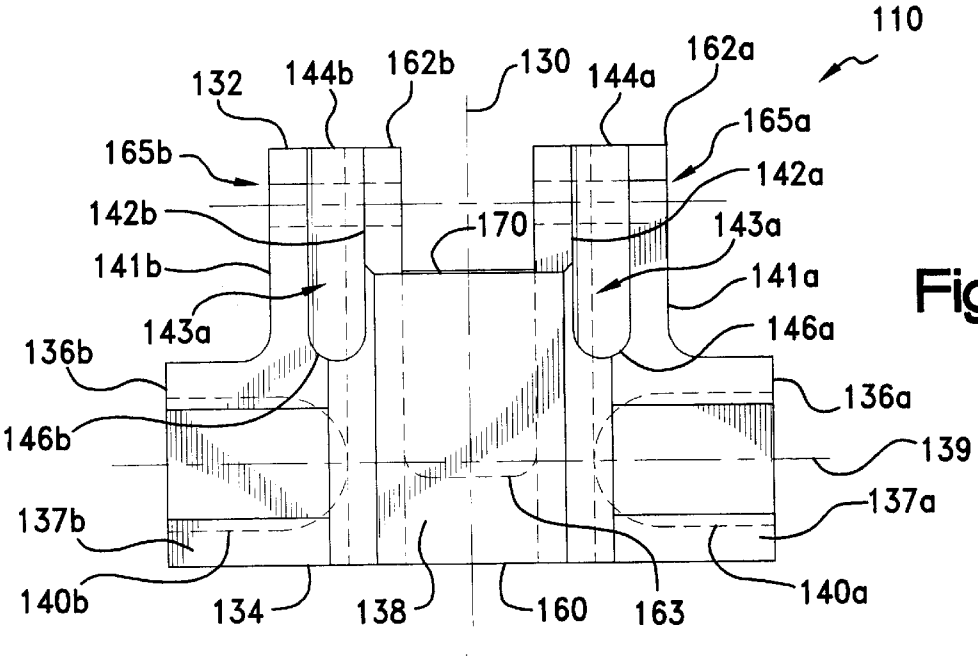
FIG. 8C is a bottom view of the reaction member of FIG. 4.
Figure 9B:
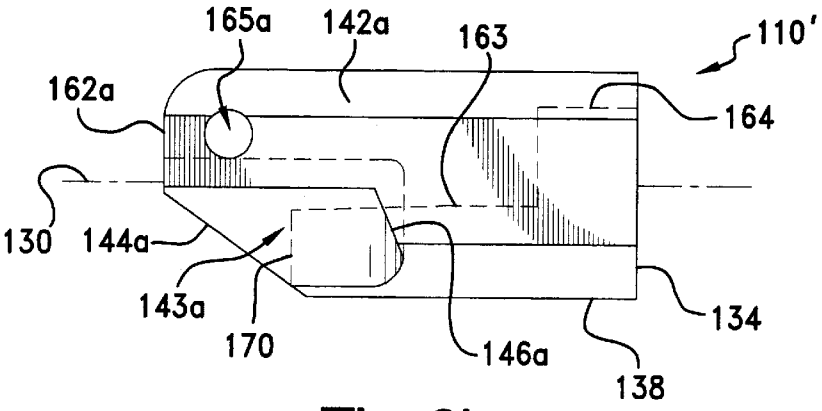
FIG. 9B is a right side view of the reaction member of FIG. 9A.
Figure 9A:
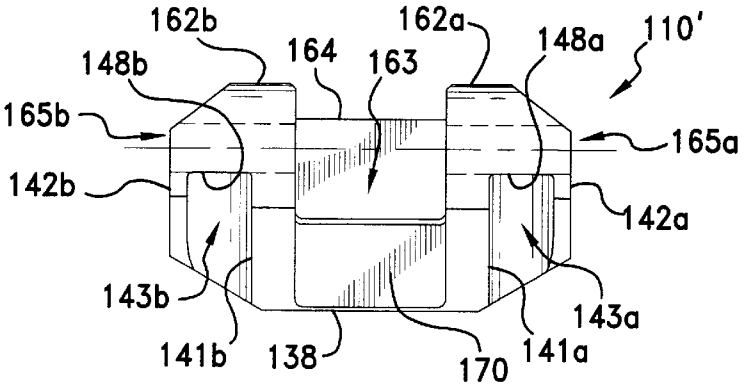
FIG. 9A is a front view of an alternative embodiment of a reaction member for the stem of the present invention.

Looking additionally to the multiview projections of FIGS. 8A–C, reaction member 110, which preferably is of a unitary construction, may be seen to extend along a first longitudinal axis, 130 (FIG. 8C), from a forward end face, 132, which is positionable in confrontation with the fastener to be engaged to an opposite, rearward end face, 134. For abutting engagement with the tubing outer surface 30 or an associated reaction bar member in a manner to be described hereinafter, reaction member 110 additional may be provided as including generally wedged-shaped first and second bearing portions, 136*a–b*, having planar lower surfaces, 137*a–b*, which may be stepped or otherwise offset relative to the lower face surface, 138, of the reaction member. Bearing portions 136 project outwardly from the reaction member intermediate ends 132 and 134 thereof along a second longitudinal axis, 139, which is disposed generally perpendicular to first longitudinal axis 130. For weight considerations, it is preferred that bearing portions are formed including the upper recessed areas shown in phantom in FIGS. 8A and 8C at 140*a–b*. For applications not requiring reaction on the tubing, however, or for applications such as in manifolds wherein access is limited, reaction member 110 may be configured as is shown at 110' in FIGS. 9A–C as lacking bearing portions 136.

In each of the illustrative preferred embodiments 110 and 110', the reaction member of the invention includes oppositely-disposed first and second lateral surfaces, 141*a–b*, each defining with a retaining flange portion, 142*a–b*, a corresponding slot, 143*a–b*, which extends along longitudinal axis 130 from a first end, 144*a–b*, opening at the forward end face 132 of reaction member 110 to a rearward end, 146*a–b*. Slots 143 are further defined within the corresponding lateral surface 141 as including an upper surface, 148*a–b*, and thereby are each configured to interchangeably receive the insertion of the shank end 122 of a wrench member 120 therein such that the jaw end 124 extends from the reaction member forward end face 132. As may be seen with momentary reference to FIGS. 4–6, when received within a slot 143 with the lower span 128 thereof positioned over and engaged with the outer surface 16 of the fitting, wrench member 120 is retained within that slot intermediate the upper surface 148 thereof and fitting body 12.

Figure 7:
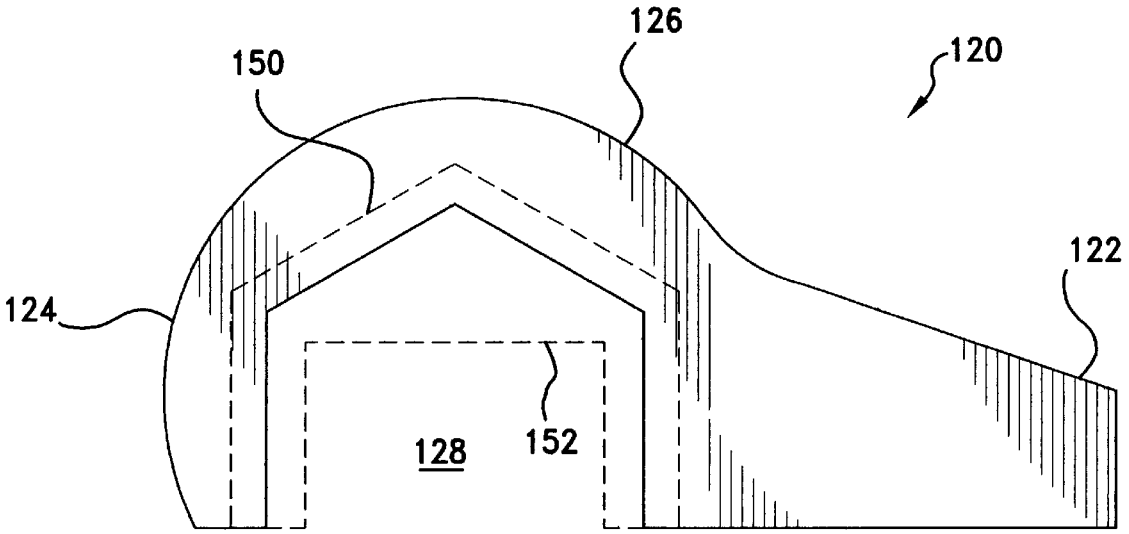
FIG. 7 is a right side elevational view of the wrench member of FIG. 4.

With slots 143 being formed as shown within each of the lateral surfaces 141, a wrench member 120 may be received within reaction member 110 to be positioned on either side of link assembly 48. For example, and as may be appreciated best with reference to FIG. 6, with wrench member 120 received within slot 143*a*, fitting body 12 may received within the jaw end 126 of the wrench in a first engagement delimiting the rotation of the fitting body about axis 104 in the first direction 102 when the body and fastener are coupled in a torque-transmitting arrangement as shown. However, with the positioning of tool 40 being reversed for the application of torque to fastener 36*a* effecting the rotation thereof in a second direction, referenced at 102', opposite first direction 102, wrench member may be disposed within slot 143*b* to receive fitting body 12 in a second engagement delimiting the rotation thereof in the second direction about axis 104. In this way, reaction member system 100 may be employed for either tightening or loosening any given one of fasteners 36. Moreover, with wrench member 120 being interchangeably received within a slot 143, a plurality of associated wrench members may be provided as configured to receive the external surface 16 of a different shape or size fitting 10. In this regard, and as may be seen with momentary reference again to FIG. 7, the lower span 128 wrench 120 may be sized, as is shown in phantom at 150 and 152, for larger or smaller size fittings 10, or for fittings having, for example, square rather than hex-shaped bodies. Thus, the reaction system 100 of the present invention advantageously may be provided for comprehensive use within a particular application.

Figure 9C:
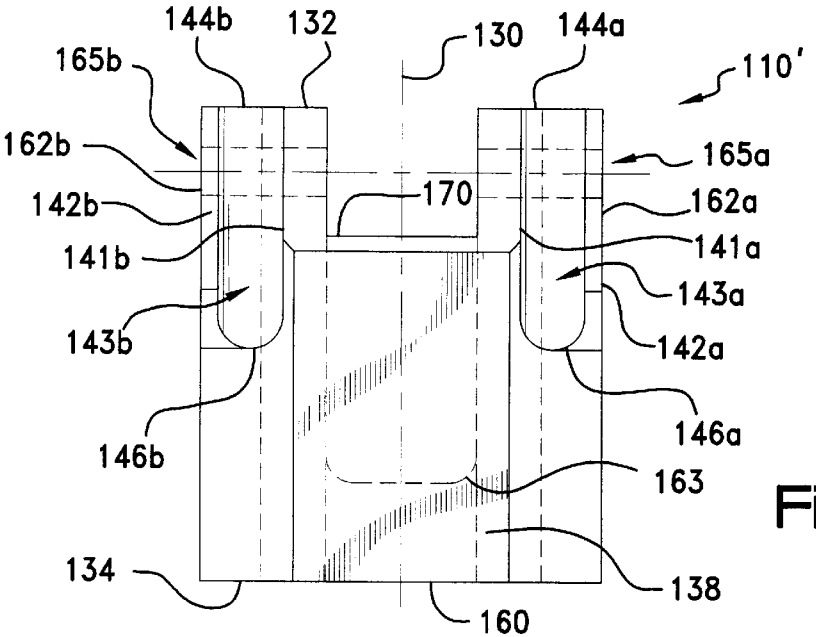
FIG. 9C is a bottom view of the reaction member of FIG. 9A.

Returning to the multiview view projections of FIGS. 8 and 9, each of reaction members 110 and 110' further are configured as including a rearward transverse portion, 160, disposed generally perpendicular to longitudinal axis 130, and spaced-apart, first and second elongate arm portions, 162*a–b*, which extend generally along longitudinal axis 130 from the forward end face 132 of the reaction member to the transverse portion 160 thereof. Arm portions 162 may be removably attached to the tool with the link assembly 48 being received therebetween within a first upper recessed surface, 163, of the reaction member, and with cylinder 44 being accommodated within a second upper recessed surface which is shown in phantom at 164 in FIGS. 8C and 9C. In this regard, arm portions 162 preferably each are formed as having a bore, 165*a–b*, extending therethrough generally perpendicular to axis 130 for registration, in succession, with aperture 62 of link body 50 and boss 64 (FIG. 2) of tool housing 42. As may be seen with additional reference to FIGS. 4–6, the removable attachment of reaction member arm portions 162 to the tool 40 over link body 50 may be secured via a pin member, 166, configured to be received coaxially through link aperture 62, tool housing boss 64, and reaction member bores 165. In such a single-point mounting arrangement, the reaction member is essentially cantilevered from the tool housing with longitudinal axis 130 thereof being aligned generally parallel to the line of action, 168, of cylinder, but as additionally supported by the abutting contact of a forwardly facing bearing surface, 170, of transverse portion 160 on link body 50.

Returning to FIGS. 4–6, in operation, with the reaction member system 100 assembled as described and with link assembly 48 being engaged with one the fasteners 36 of fitting 10, fluid pressure may be admitted under the control of an operator into cylinder 44 to effect the rotation of ratchet wheel 75 and, concomitantly, the fastener 36 in the first or second direction 102 or 102' about the axis of rotation 104. For tightening, i.e., make or remake operations, the number of revolutions of the fastener may be counted to ensure that a complete, fluid-tight connection is obtained. In this regard, the fastener first may be pre-made to hand tight to ensure a consistent starting point. Alternatively, depending upon the features and capabilities of the tool 40, the fastener 36 may be rotated to a preset torque.

Figure 10:
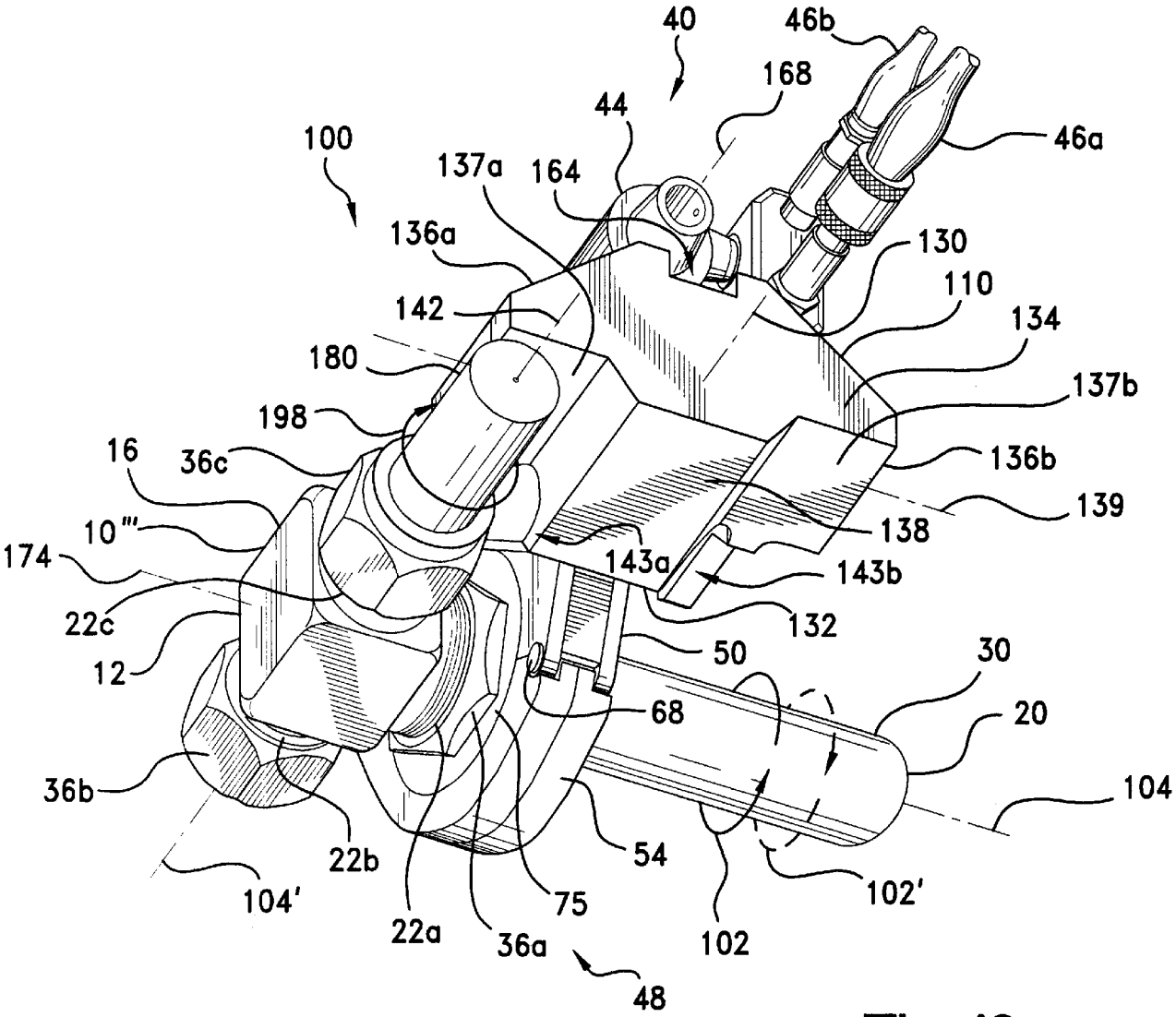
FIG. 10 is a perspective rear elevational view of the reaction member system of the resent invention as operably engaged with one port end of a tee-shaped tube fitting and as ncluding an associated reaction bar member which is received within a port end of the itting adjacent the engaged end.

Turning to FIG. 10, the use of reaction system 100 in connection with the assembly a tee shape tube fitting, 10'41, is next described. Fitting 10''' includes parallel port ends 36*b–c* which extend along a first fitting axis, 172, and a side port 36*a* which extends along a second fitting axis, which is commonly referenced at 174 with rotational axis 104. With respect to the make-up of side port end 22*a* of the fitting 10''', it will be appreciated that no direct access is available to the fitting external surface 16 for the engagement of wrench member 120. However, as aforementioned, bearing portions 136 of reaction member 110 are provided for alternative reaction on the tubing of an adjacent port delimiting, again as depending upon the orientation of the link assembly 48 relative to the fastener, the rotation of the fitting body 12 in the first or second direction 102 or 102' about axis of rotation 104 when the body and fastener are coupled, as shown, in a torque-transmitting arrangement. That is, in the example illustrated in FIG. 10, the lower surface 137*a* of outwardly-extending bearing portion 136*a* abuttingly engages the outer surface of an adjacent length of tubing to delimit the rotation of the fitting body 12 in the first direction 102 about axis 104. Advantageously, by reacting upon the tubing, the bending load on the fitting is minimized while providing rotation delimiting access to all the ports of the fitting.

Figure 11:
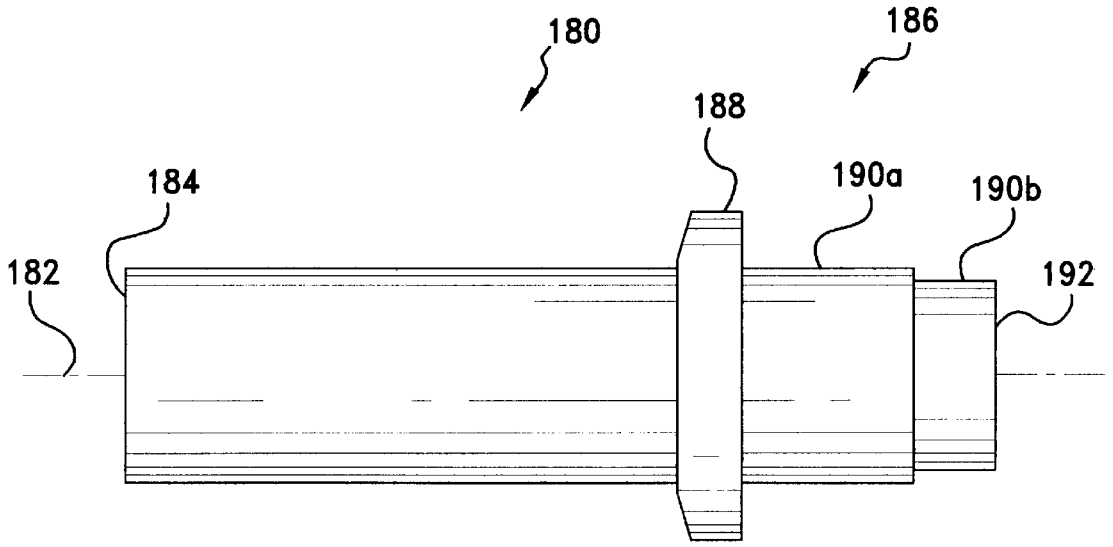
FIG. 11 is an axial cross-sectional view of the reaction bar member of FIG. 10.
Figure 12:
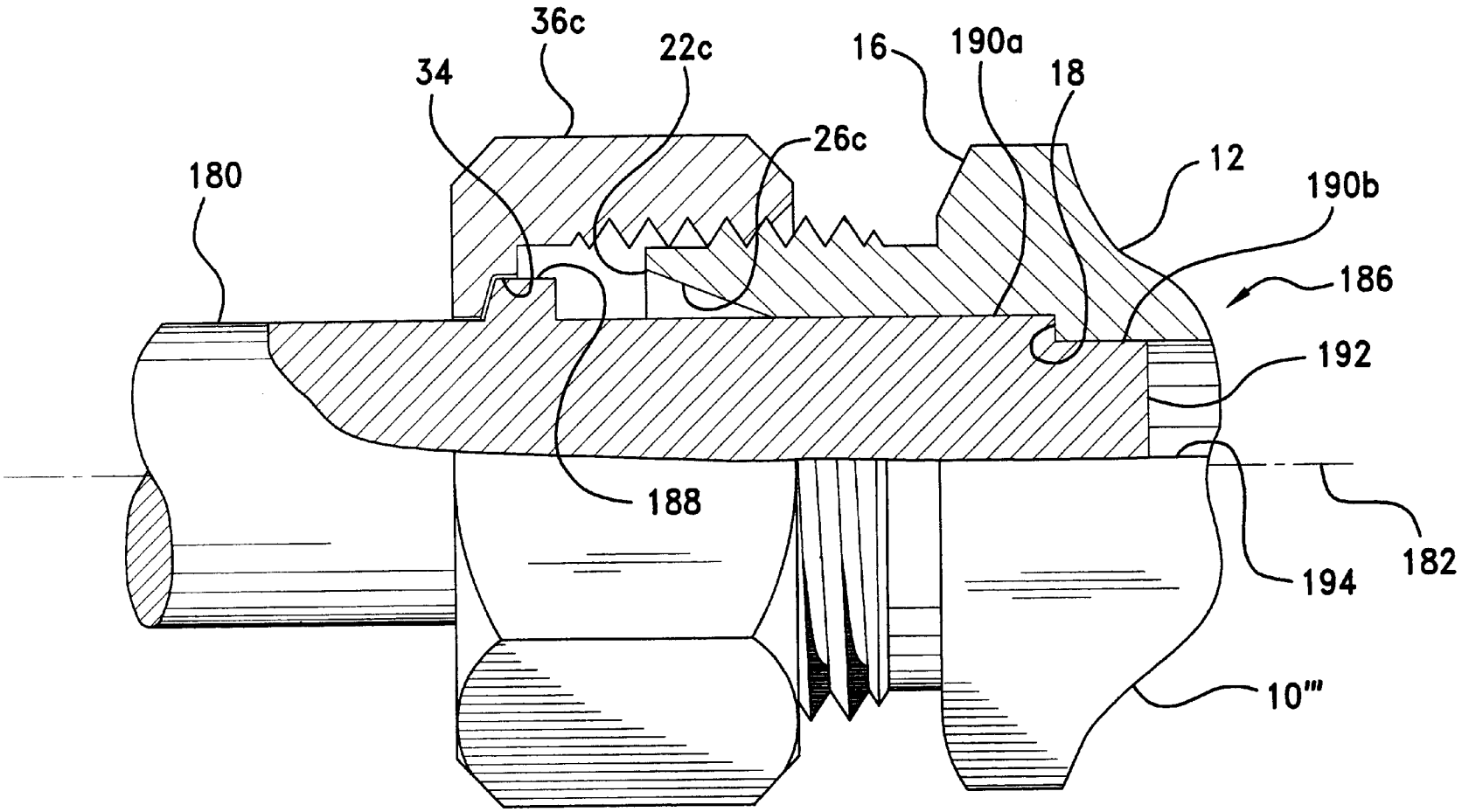
FIG. 12 is a fragmentary side elevational view, partially in longitudinal cross-section, showing the internal coupling of the reaction bar member of FIG. 10 to the corresponding port end of the fitting body.

Of course, for the first port connected, or for the last port disconnected, no adjacent tubing length will be available upon which one of the bearing portions 136 may be reacted. In this regard, and as is shown at 180 in FIG. 10, a separate, generally cylindrical reaction bar or tube member may be provided to substitute for the missing tubing length. As may be seen best with additional reference to the cross-sectional view of shown in FIG. 11, reaction bar 180 extends along a central longitudinal axis, 182, from a rearward distal end, 184, to a forward distal end portion, referenced generally at 186, which is configured to be received within port end 22*c* of fitting 10'''. Forward distal end portion 186 is adapted to be retained within fitting port end 22*c* by the associated fastener 36*c* as having a radially outwardly extending, circumferential flange portion, 188, and one or more reduced diameter step portions, 190*a–b*, formed intermediate flange 188 and the forward terminus, 192, of the end portion 186. That is, and as is shown in the cross-sectional assembly view of FIG. 12, with fastener 36*c* being received coaxially over reaction bar 180, fastener 36*c* may be threadably rotatably engaged with the port end 26*c* of fitting 10''' such that the radially inwardly-extending shoulder 34 of the fastener abuttingly engages the flange 188 of reaction bar 180 to urge step port 190*a* thereof into the internal stop 18 of fitting body 12. Step portion 190*b*, however, preferably is configured to extend forwardly beyond stop 18 for providing additional force-transferring contact with the fitting internal surface 194. In this way, the reaction forces developed on bar 180 may be distributed along the non-sealing surfaces of the fitting port end 22*c* to prevent damage to the sealing surface 26*c* thereof.

Returning momentarily to FIGS. 4 and 5, it may be appreciated that the provision reaction member 110 as configured to include both bearing portions 136 and wrench member 120 advantageously broadens the access opportunities for assembling or disassembling a fitting such as fitting 10' having perpendicular or other angularly-oriented fitting axes, such as the first and second fitting axes 172 and 174. For example, depending upon the access provided within the service area, wrench member 120 may be engaged with fitting body 12 as shown allowing for the rotation of fastener 36*a* in the direction 102 about axis 104. However, should adjacent runs of tubing, filters, valves, process equipment, structural members, or the like make the fitting body inaccessible with wrench 120, then, for example, link assembly 48 may be reoriented such that bearing portion 136*a* is positioned to engage, as is shown in phantom at 196, either a tubing length or a reaction bar member 180 which may be received within the adjacent port end 22*b* of the fitting. Similarly, a wrench member 120 may be employed, as in FIG. 10, for engaging body 12 of fitting 10''' allowing for the rotation of, for example, fastener 36*c* about axis 104' in the direction referenced at 198.

Figure 13:
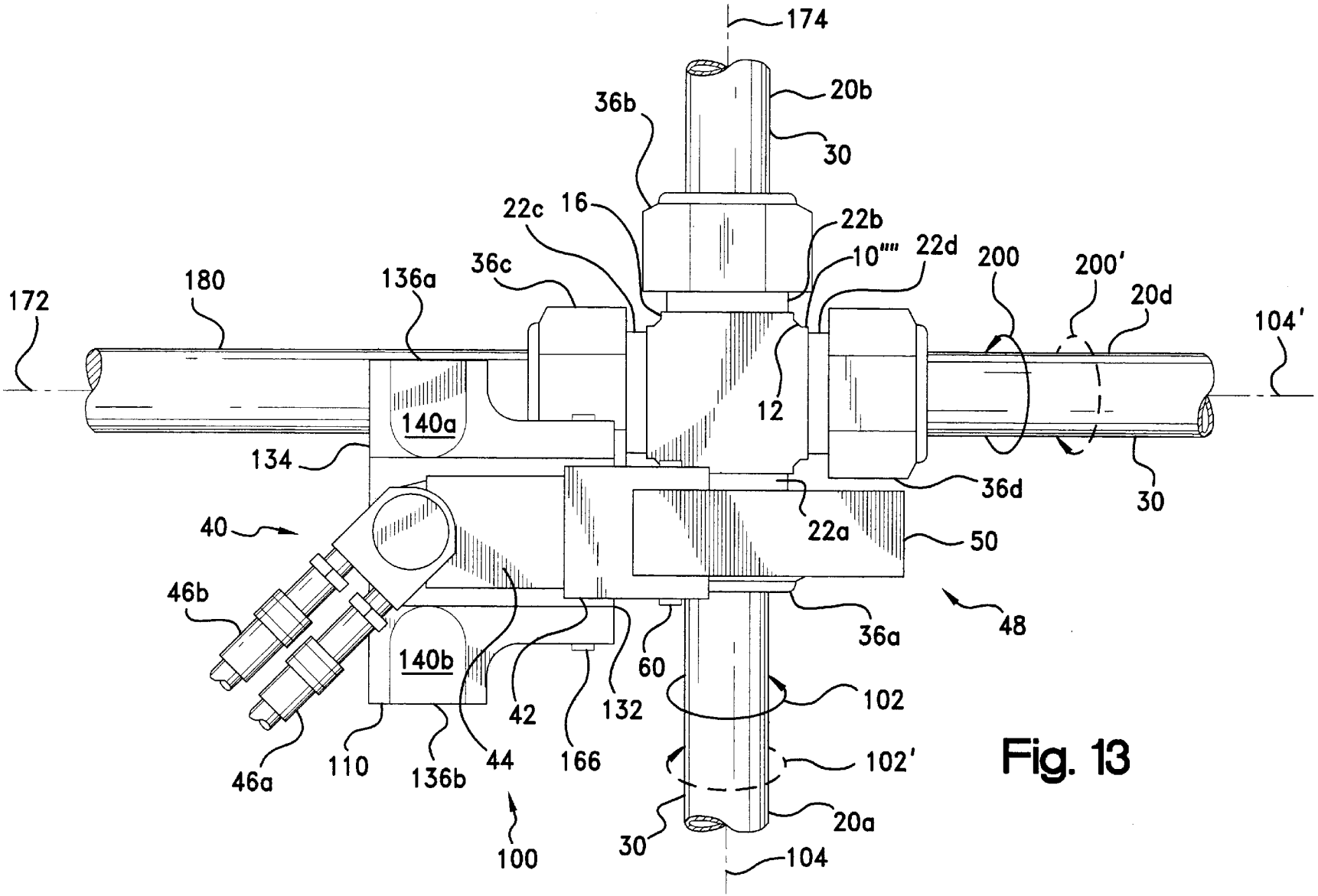
FIG. 13 is a top view of the reaction member system FIG. 10 operably engaged with one port end of a cross-shaped tube fitting.

Looking lastly to FIG. 13, the use of system 100 in connection the assemble of a cross shape tube fitting 10'''' is illustrated with, for example, reaction bar 180 being received within port end 22*c* and with link assembly 48 being engaged to tighten the fastener 36*a* of the immediately adjacent port end 22*a*. In such an arrangement, bearing portion 136*a* of reaction member 110 is positioned to abuttingly engage reaction bar 180 delimiting the rotating of fitting body 12 in direction 102 about axis 104. As before, for the rotation of the fastener 36*a* in the reverse direction 102', the orientation of link assembly 48 may be reversed to engage fastener 36*a* such that bearing portion 136*b* abuttingly engages tubing 20*d* of the other adjacent port end 22*d*. Similarly, to tighten fastener 36*d*, with link assembly 48 operably engaged therewith, the lower surface 137*a* of reaction member 110 bearing arm portion 136*a* is positionable to abuttingly engage tubing 20*a* of port end 22*a* delimiting the rotation of fitting body 12 about axis 104' in the direction referenced at 200. Likewise, to loosen fastener 36*d*, with the orientation of link assembly 48 reversed, the lower surface 137*b* of bearing arm portion 136*b* is positionable to abuttingly engage tubing 20*b* of port end 22*b* delimiting the rotation of fitting body 12 about axis 104' in the direction referenced at 200'. In a similar manner, and with reaction arm member 180 being substituted as needed for tubing lengths 20, each of the fasteners 36 may be accessed from either direction of the fitting for the making, remaking, or disassembly thereof.

Materials of construction suitable for the components of the reaction member system of the present invention are to be considered conventional for the uses involved. Preferably, reaction and wrench members 110 and 120 are machined or otherwise formed of a hardened mild steel or the like, with reaction bar member 180 being formed of an aluminum material for weight considerations and for ease of machining. Other types of materials may be substituted, however, as selected for compatibility with the service environment or for desired mechanical properties.

Thus, a unique reaction member system for rotary fluid-operated wrench tools is described which adapts these tools for use on large size tube fittings. With the system, the connections in such fittings thereby may be made, remade, or disassembled by a single operator and in a manner which is safer than the hand-wrench methods heretofore known in the art.

As it is anticipated that certain changes may be made in the present invention without departing from the precepts herein involved, it is intended that all matter contained in the foregoing description shall be interpreted in as illustrative rather than in a limiting sense. All references cited herein are expressly incorporated by reference.

What is claimed is:

1. A reaction system in combination with a tool for use in assembling or disassembling a fitting including a body having an external surface of a defined outer geometry, at least one port end configured to receive a distal end of a length of tubing, and a fastener journalable over the tubing distal end and rotatable about a central axis of rotation for threadably engaging the fitting port end, the tool including a housing, a cylinder assembly incorporated within the housing having a line of action directable generally perpendicular to an axis of rotation of a fastener on the fitting port end, and a link assembly operably coupled to the cylinder assembly for actuation by a power stoke of said cylinder assembly to rotate a ratchet wheel of said tool in a torque-developing working direction, said ratchet wheel being engagable in a first orientation with a fastener for applying torque to the fastener effecting the rotation thereof in a first direction about its axis of rotation, and being engagable in a second orientation with a fastener for applying said torque to a fastener effecting the rotation thereof in a second direction about its axis of rotation opposite the first direction, said system comprising:

a reaction member attachable to the tool as extending along a central longitudinal axis disposed general parallel to the line of action of the cylinder assembly from a forward end face positionable in confrontation with the fastener to an opposite rearward end face; and at least one associated wrench member having a rearward shank end and a forward jaw end formed as having a closed upper portion and an open lower span receivable over the external surface of a fitting body in a first engagement position restricting the rotation of a fitting body in said first direction about said axis of rotation in the first orientation of said ratchet wheel, and in a second engagement position restricting the rotation of a fitting body in said second direction about said axis of rotation in the second orientation of said ratchet wheel, wherein said reaction member has a first lateral surface defining a first slot which extends along said longitudinal axis from a first end opening at the forward end face of said reaction member to a rearward second end, and a second lateral surface disposed opposite said first lateral surface, said second lateral surface defining a second slot which extends along said longitudinal axis from a first end opening at the forward end face of said reaction member to a rearward second end, said first and said second slot each being configured to interchangeably receive the shank end of said wrench member for alternately positioning the jaw end thereof to extend from the forward end face of said reaction member on opposites sides of said longitudinal axis such that the lower span of said jaw end is receivable in said first and said second engagement position over the external surface of the fitting body.

2. The reaction system of claim 1 wherein a fitting includes a first port end disposed along a first fitting axis and configured to receive a distal end of a first length of tubing, at least a second port end disposed along a second fitting axis generally perpendicular to the first fitting axis and configured to receive a distal end of a second length of tubing, and at least a first and a second fastener each journalable over an associated tubing distal end and rotatable, respectively, about a central axis of rotation for threadably engaging the corresponding port end of the fitting, wherein the cylinder assembly line of action is directable generally perpendicular to the axis of rotation of at least one of the fasteners on the corresponding fitting port end, and wherein said ratchet wheel is engagable with at least one of the fitting fasteners for applying said torque to that fastener effecting the rotation thereof in a first direction about its axis of rotation, said reaction member being configured as having at least a first bearing portion projecting outwardly therefrom a first predetermined distance along a second longitudinal axis disposed generally perpendicularly to said first longitudinal axis, wherein said first predetermined distance is selected such that with the distal ends of the first and seconds lengths of tubing being received within the corresponding port end of the fitting, and with the ratchet wheel of the link assembly being engaged with the second fastener as journaled over the distal end of the second length of tubing, said reaction member first bearing portion is abuttingly engagable with the first length of tubing delimiting the rotation of the fitting body in said first direction about the axis of rotation of the second fastener.

3. The reaction system of claim 2 wherein said reaction member further is configured as having a second bearing portion projecting outwardly therefrom opposite said first bearing portion a second predetermined distance along said second longitudinal axis, wherein said second predetermined distance is selected such that with the distal ends of the first and seconds lengths of tubing being received within the corresponding port end of the fitting, and with the ratchet wheel of the link assembly being engaged with the first fastener as journaled over the distal end of the first length of tubing, said reaction member second bearing portion is abuttingly engagable with the second length of tubing restricting the rotation of the fitting body in said first direction about the axis of rotation of the first fastener.

4. The reaction system of claim 1 further comprising a plurality of associated wrench members interchangeably receivable within said first and said second slot, each of said members having a second end configured to receive the external surface of a different fitting body.

5. The reaction system of claim 1 wherein said first and said second slot each is further defined within said first and said second lateral surface as including an upper surface, said wrench member being retainable interchangeably within said first and said second slot intermediate said upper surface and the body of the fitting.

6. The reaction system of claim 1 wherein said reaction member is configured as including a rearward transverse portion disposed generally perpendicular to said longitudinal axis, and spaced-apart first and second elongate arm portions each extending along said longitudinal axis from said forward end face of said reaction member to said transverse portion thereof, said arm portions being attachable to the tool with the link assembly thereof being received therebetween.

7. The reaction system of claim 6 wherein the housing of the tool includes a downwardly-depending boss, and wherein said elongate arm portions of said reaction member each are formed as having a bore extending therethrough generally perpendicular to said longitudinal axis for registration with the boss of the tool, said system further comprising a pin member configured to be received through the boss and the bores of said reaction member arm portions for removably cantilevering said reaction member from the tool.

8. The reaction system of claim 7 wherein said transverse portion of said reaction member includes a forward surface configured for abutting contact with the link assembly of the tool supporting said reaction member thereon.

9. A reaction system in combination with a tool for applying torque to a first member which is rotatable about an axis of rotation relative to a second member couplable in a torque transmitting arrangement therewith, the tool including a housing, a cylinder assembly incorporated within the housing having a line of action directable generally perpendicular to an axis of rotation of the first member, and a link assembly operably coupled to the cylinder assembly for actuation by a power stoke of said cylinder assembly to rotate a ratchet wheel of said tool in a torque-developing working direction, said ratchet wheel being engagable in a first orientation with the first member for applying said torque effecting the rotation of the first member in a first direction about its axis of rotation, and being engagable in a second orientation with the first member for applying said torque to the fastener effecting the rotation thereof in a second direction about its axis of rotation opposite the first direction said system comprising:

a reaction body attachable to the tool as extending along a central longitudinal axis disposed general parallel to the line of action of the cylinder assembly from a forward end face positionable in confrontation with the first member to an opposite rearward end face; and at least one associated wrench having a rearward shank end and a forward jaw end formed as having a closed upper portion and an open lower span receivable over the first member in a first engagement position restricting the rotation thereof in said first direction about said axis of rotation in the first orientation of said ratchet wheel when the first and second members are coupled in said torque-transmitting arrangement, and in a second engagement position restricting the rotation of the first member in said second direction about said axis of rotation in the second orientation of said ratchet wheel, wherein said reaction body has a first lateral surface defining a first slot which extends along said longitudinal axis from a first end opening at the forward end face of said reaction body to a rearward second end, and a second lateral surface disposed opposite said first lateral surface, said second lateral surface defining a second slot which extends along said longitudinal axis from a first end opening at the forward end face of said reaction body to a rearward second end, said first and said second slot each being configured to interchangeably receive the shank end of said wrench member for alternately positioning the jaw end thereof to extend from the forward end face of said reaction body on opposites sides of said longitudinal axis such that the lower span of said jaw end is receivable in said first and said second engagement position over the first member.

10. A reaction system in combination with a tool in assembling or disassembling a fitting including a body having an external surface of a defined outer geometry, a first port end disposed along a first fitting axis and configured to receive a distal end of a length of tubing, at least a second end disposed along a second fitting axis generally perpendicular to the first fitting axis and configured to receive a distal end of a second length of tubing, and at least a first and a second faster each journalable over an associated tubing distal end and rotatable respectively, about a central axis of rotation for threadably engaging the corresponding port end of the fitting, the tool including a housing, a cylinder assembly incorporated within the housing having a line of action directable generally perpendicular to an axis of rotation of at least one of the fasteners on the corresponding fitting port end, and a link assembly operably coupled to the cylinder assembly for actuation by a power stoke of said cylinder assembly to rotate a ratchet wheel of said tool in a torque-developing working direction, said ratchet wheel being engagable with at least one of the fitting fasteners for applying said torque to that fastener effecting the rotation thereof in a first direction about its axis of rotation, said system comprising:

a reaction member attachable to the tool as extending along a first longitudinal axis disposed general parallel to the line of action of the cylinder assembly from a forward end face positionable in confrontation with the fastener to an opposite rearward end face, said reaction member having at least a first bearing portion projecting outwardly therefrom along a second longitudinal axis disposed generally perpendicularly to said first longitudinal axis, at least one associated reaction bar member having a distal end configured to be received within the first port end of the fitting, whereby with the distal end of said reaction bar member being received within the first port end of the fitting, and with the ratchet wheel of the link assembly being engaged with the second fastener as joumaled over the distal end of the second length of tubing, said reaction member first bearing portion is abuttingly engagable with said reaction bar member restricting the rotation of the fitting body in said first direction about the axis of rotation of the second fastener.

11. The reaction system of claim 10 wherein said reaction member has a second bearing portion projecting outwardly therefrom opposite said first bearing portion a second predetermined distance along said second longitudinal axis, wherein said second predetermined distance is selected such that with the distal ends of the first and seconds lengths of tubing being received within the corresponding port end of the fitting, and with the ratchet wheel of the link assembly being engaged with the first fastener as journaled over the distal end of the first length of tubing, said reaction member second bearing portion is abuttingly engagable with the second length of tubing restricting the rotation of the fitting body in said first direction about the axis of rotation of the first fastener.

12. The reaction system of claim 11 wherein said reaction member is configured as including a rearward transverse portion extending along said second longitudinal axis intermediate said first and second bearing portions, and spaced-apart first and second elongate arm portions each extending along said longitudinal axis from said forward end face of said reaction member to said transverse portion thereof, said arm portions being attachable to the tool with the link assembly thereof being received therebetween.

13. The reaction system of claim 12 wherein the housing of the tool includes a downwardly-depending boss, and wherein said elongate arm portions of said reaction member each are formed as having a bore extending therethrough generally perpendicular to said longitudinal axis for registration with the boss of the tool, said system further comprising a pin member configured to be received through the boss and the bores of said reaction member arm portions for removably cantilevering said reaction member from the tool.

14. The reaction system of claim 13 wherein said transverse portion of said reaction member includes a forward surface configured for abutting contact with the link assembly of the tool supporting said reaction member thereon.

15. The reaction system of claim 11 wherein the ratchet wheel of the tool is engagable with the first fitting fastener for applying said torque to that fastener effecting the rotation thereof in a second direction about its axis of rotation opposite the first direction, and with the second fitting fastener for applying said torque to that fastener effecting the rotation thereof in a second direction about its axis of rotation opposite the first direction, and wherein said reaction system further comprises at least one associated wrench member having a rearward shank end mountable to said reaction member and a forward jaw end configured to receive a portion of the external surface of the fitting body in a first engagement delimiting the rotation of the fitting body in said second direction about the axis of rotation of the first fastener, and in a second engagement delimiting the rotation of the fitting body in said second direction about the axis of rotation of the second fastener.

16. The reaction system of claim 15 wherein said reaction member has at least a first lateral surface defining, a first slot which extends along said longitudinal axis from a first end opening at the forward end face of said reaction member to a rearward second end, said slot being configured to receive the shank end of said wrench member therein such that the jaw end thereof extends from the forward end face of said reaction member for receiving the external surface of the fitting body in said first engagement, and wherein said reaction member has a second lateral surface disposed opposite said first lateral surface, said second lateral surface defining a second slot which extends along said longitudinal axis from a first end opening at the forward end face of said reaction member to a rearward second end, said second slot being configured to receive the shank end of said wrench member therein such that the jaw end thereof extends from the forward end face of said reaction member for receiving the external surface of the fitting body in said second engagement.

17. The reaction system of claim 11 wherein the ratchet wheel of the tool is engagable with the second fitting fastener for applying said torque to that fastener effecting the rotation thereof in a second direction about its axis of rotation opposite the first direction, and wherein said reaction system further comprises at least one associated wrench member having a rearward shank end mountable to said reaction member and a forward jaw end configured to receive a portion of the external surface of the fitting body in an engagement delimiting the rotation of the fitting body in said second direction about the axis of rotation of the second fastener.

18. The reaction system of claim 17 wherein said reaction member has at least a first lateral surface defining a first slot which extends along said longitudinal axis from a first end opening at the forward end face of said reaction member to a rearward second end, said slot being configured to receive the shank end of said wrench member therein such that the jaw end thereof extends from the forward end face of said reaction member.

19. The reaction system of claim 11 wherein the ratchet wheel of the tool is engagable with the second fitting fastener for applying said torque to that fastener effecting the rotation thereof in a second direction about its axis of rotation opposite the first direction, and wherein said reaction system further comprises at least one associated wrench member having a rearward shank end mountable to said reaction member and a forward jaw end configured to receive a portion of the external surface of the fitting body in a first engagement delimiting the rotation of the fitting body in said second direction about the axis of rotation of the first fastener, and in a second engagement delimiting the rotation of the fitting body in said second direction about the axis of rotation of the second fastener.

20. The reaction system of claim 9 further comprising a plurality of associated wrenches interchangeably receivable within said first and said second slot, each of said wrenches having a second end configured to receive a different second member.

21. The reaction system of claim 9 wherein said first and said second slot each is further defined within said first and said second lateral surface as including an upper surface, said wrench being retainable interchangeably within said first and said second slot intermediate said upper surface and the second member.

22. The reaction system of claim 9 wherein said reaction body is configured as including a rearward transverse portion disposed generally perpendicular to said longitudinal axis, and spaced-apart first and second elongate arm portions each extending along said longitudinal axis from said forward end face of said reaction body to said transverse portion thereof, said arm portions being attachable to the tool with the link assembly thereof being received therebetween.

23. The reaction system of claim 22 wherein the housing of the tool includes a downwardly-depending boss, and wherein said elongate arm portions of said reaction body each are formed as having a bore extending therethrough generally perpendicular to said longitudinal axis for registration with the boss of the tool, said system further comprising a pin configured to be received through the boss and the bores of said reaction body arm portions for removably cantilevering said reaction body from the tool.

24. The reaction system of claim 23 wherein said transverse portion of said reaction body includes a forward surface configured for abutting contact with the link assembly of the tool supporting said reaction body thereon.

* * * * *